United States Patent [19]

McKinley et al.

[11] 4,280,122

[45] Jul. 21, 1981

[54] OPTICAL FIBERS

[75] Inventors: Ronald R. McKinley, Lawrence; Robert E. Hamel, Jr., Amesbury; Bernard J. Dolan, Stoneham, all of Mass.

[73] Assignee: Dolan-Jenner Industries, Inc., Woburn, Mass.

[21] Appl. No.: 164,835

[22] Filed: Jun. 30, 1980

[51] Int. Cl.[3] ..... G08B 5/00; G09F 19/12; F21V 7/04

[52] U.S. Cl. ..... 340/380; 362/32

[58] Field of Search ..... 340/380, 365 P; 362/32, 362/35; 350/96.24; 40/547; 116/DIG. 5

[56] References Cited

U.S. PATENT DOCUMENTS

| | | | |
|---|---|---|---|
| 1,351,562 | 8/1920 | Foster | 340/380 |
| 2,227,861 | 1/1941 | Petrone | 340/380 |
| 3,431,410 | 3/1969 | Dolan et al. | 362/32 X |
| 3,536,908 | 10/1970 | Oster | 362/32 X |
| 3,662,381 | 5/1972 | Steffens | 340/380 X |
| 3,786,500 | 1/1974 | Fiorletta et al. | 340/380 |
| 3,836,911 | 9/1974 | Gibson et al. | 340/380 |
| 3,962,702 | 6/1976 | Kriege | 340/380 |
| 4,035,215 | 7/1977 | Goldstone | 156/245 |
| 4,097,917 | 6/1978 | McCaslin | 362/35 X |

FOREIGN PATENT DOCUMENTS

| | | | |
|---|---|---|---|
| 2806076 | 8/1979 | Fed. Rep. of Germany | 362/32 |
| 2028561 | 3/1980 | United Kingdom | 350/96.24 |

*Primary Examiner*—John W. Caldwell, Sr.
*Assistant Examiner*—Daniel Myer

[57] ABSTRACT

Free parallel ends of optical fibers are spaced apart between a viewing window of the one way type disposed to provide an inner reflective surface and a rear facing mirror in back of which the fibers are bundled against which light of constantly changing color is directed. While some free filament ends may be stationary, others are subject to displacement in a manner such that their lit ends appear as pin points of light moving in space.

13 Claims, 4 Drawing Figures

OPTICAL FIBERS

BACKGROUND REFERENCES

U.S. Pat. No. 3,431,410
U.S. Pat. No. 4,035,215
U.S. Pat. No. 4,097,917

BACKGROUND OF THE INVENTION

The ability of optical fibers to transmit light substantially as pin points is, of course, well known and has been utilized to advantage in many different ways among which are display devices where light applied to corresponding bundled ends of fibers is displayed at their other ends in an attractive manner.

Of such display devices, U.S. Pat. No. 3,431,410 disclosed the use of optical fibers having their bundled ends disposed with a rotating color wheel interposed between them and a light source with their free ends falling over the upper end of a holder.

The display device of U.S. Pat. No. 4,035, 215 included three assemblies of optical fibers each of which has fixed bundled ends with their other ends free and disposed as sprays movable in response to fan created air currents. The intensity of the light produced by the lamp operatively associated with the bundled ends of each assembly varied with variations in an associated stereo output.

In yet another display device, see U.S. Pat. No. 4,097,917, the bundled ends of optical fibers were rotated as a unit with the other ends of the fibers free to respond to rotative forces to provide lines of light varying with the speed at which the bundle was rotated.

THE PRESENT INVENTION

The general objective of the present invention is to provide display devices in which the lit ends of optical fibers appear as pin points of light moving in space, desirably, but not necessarily, with other lit ends stationary.

In accordance with the invention this objective is attained with a box divided by a partition into front and rear sections with the front of a box a one way window with its interior surface functioning as a mirror. Optical fibers extend forwardly through the partition in a predetermined spaced apart, parallel relationship with their ends in the rear section held as a bundle against which light, desirably of constantly changing color is directed.

The optical fibers are so dimensioned in relation to their length that their free ends are resilient and have normal positions at right angles to the window. Means are provided momentarily to displace at least some of the fibers so that when the box is viewed from the front, their lit ends appear as points of light moving in space. It is preferred that some of the free fiber ends are stationary and it is preferred that the opacity of the window be such that only the lit ends of the fibers be visible to the viewer.

An important objective of the invention is to enable the effect of a large number of pin points of light to be attained with relatively few fibers. This objective is achieved by having the partition a mirror facing the front of the box so that light is reflected between it and the rear surface of the window and reflected through the front of the box as fibers are displaced and return to their normal positions.

Another objective of the invention is to effect the displacement and return of free ends of fibers in a wanted manner. For this purpose, a shaft driven by a motor in the rear section of the box, where the shaft has a color wheel or disc, extends through the partition into the front section where it carries at least one cam. Free fiber ends that are to be displaced thereby are arranged as a concentric set in the path of lobes of the cam.

A further objective of the invention is to have pin points of light that may be made to move both in a regular manner and in an erratic manner. To that end, the shaft is provided with a second cam in the front section. The paths of the lobes of the two cams are concentric with the one cam whose lobes have the longer radius ahead of the other cam. Fiber ends to be displaced by the smaller cam are arranged as a concentric set in the path of the lobes of that cam with the larger cam translucent to enable the lit ends of the second named set to be observed. It is preferred that an inner one way window be located between the front window and the mirror with its rear surface functioning as a mirror.

Other objectives, novel features and advantages of the present invention will be apparent from the accompanying drawings, the specification and the appended claims.

BRIEF DESCRIPTION OF THE DRAWINGS

The accompanying drawings illustrate a preferred embodiment of the invention of which -

and

Figure 4:
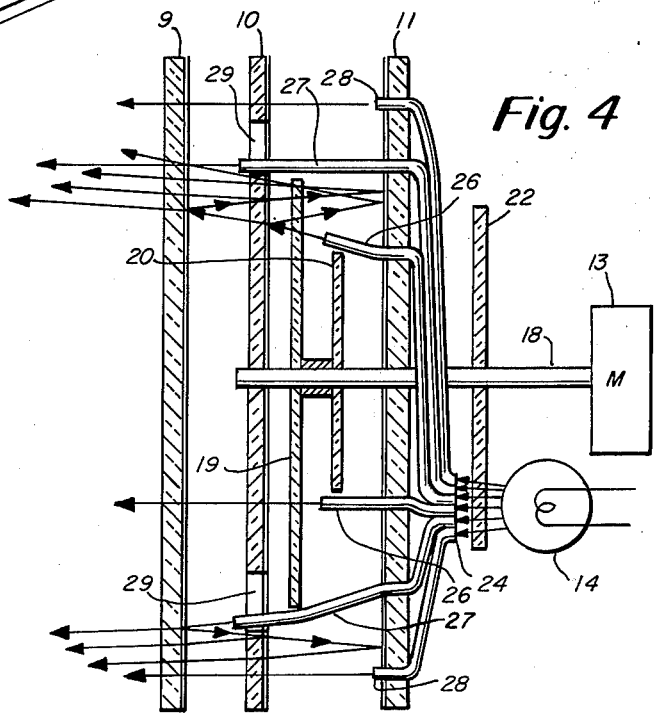

FIG. 4 is a somewhat schematic and much simplified view illustrating the functioning of the components of the device.

THE PREFERRED EMBODIMENT OF THE INVENTION

The light display device illustrated by the drawings has an open ended box or housing, generally indicated at 5 which is shown as consisting of a bottom 5A in the form of a channel that is rectangular in cross section and a cover 5B. The bottom 5A and the cover 5B are provided with vertically aligned slots of channels 6, 7, and 8.

The slots 6 receive and hold a window 9 of the one way type which closes the front of the box 5 and a sheet, either glass or plastic, and disposed so that its rear surface functions as a mirror. The slots 7 receive and support a like one way window 10 so disposed that the rear surface functions as a mirror while the sots 8 receive and support a mirror 11 facing the front of the box. The mirror 11 is a partition dividing the box 5 into front and rear sections.

The other or rear end of the box is closed by a plate 12 to the interior of which is secured a motor 13 and a lamp 14. The plate 12 has a port 15 through which a cord 16 extends with its leads 16A and 16B at one end connected to the corresponding leads of the motor and lamp and with the other lead ends connected to a plug 17.

The shaft 18 of the motor 13 extends freely through the one way mirror 11 and the one way sheet 10 between which there is a first or front cam 19 and a second or rear cam 20 both of which are of transparent material and are fast on the shaft 18 with a spacer 21 between them. The two cams differ both in size and shape and in function. The lobes 20A of the cam 20 are shown as arcuate and four in number and uniform in shape and in radial extent. The lobes of the cam 19 are shown as seven in number and as uniform in radial extent. As each varies in size and shape from any other, the lobes are designated 19A, 19B, 19C, 19D, 19E, 19F, and 19G and their path is outside the path of the lobes 20A.

Figure 1:
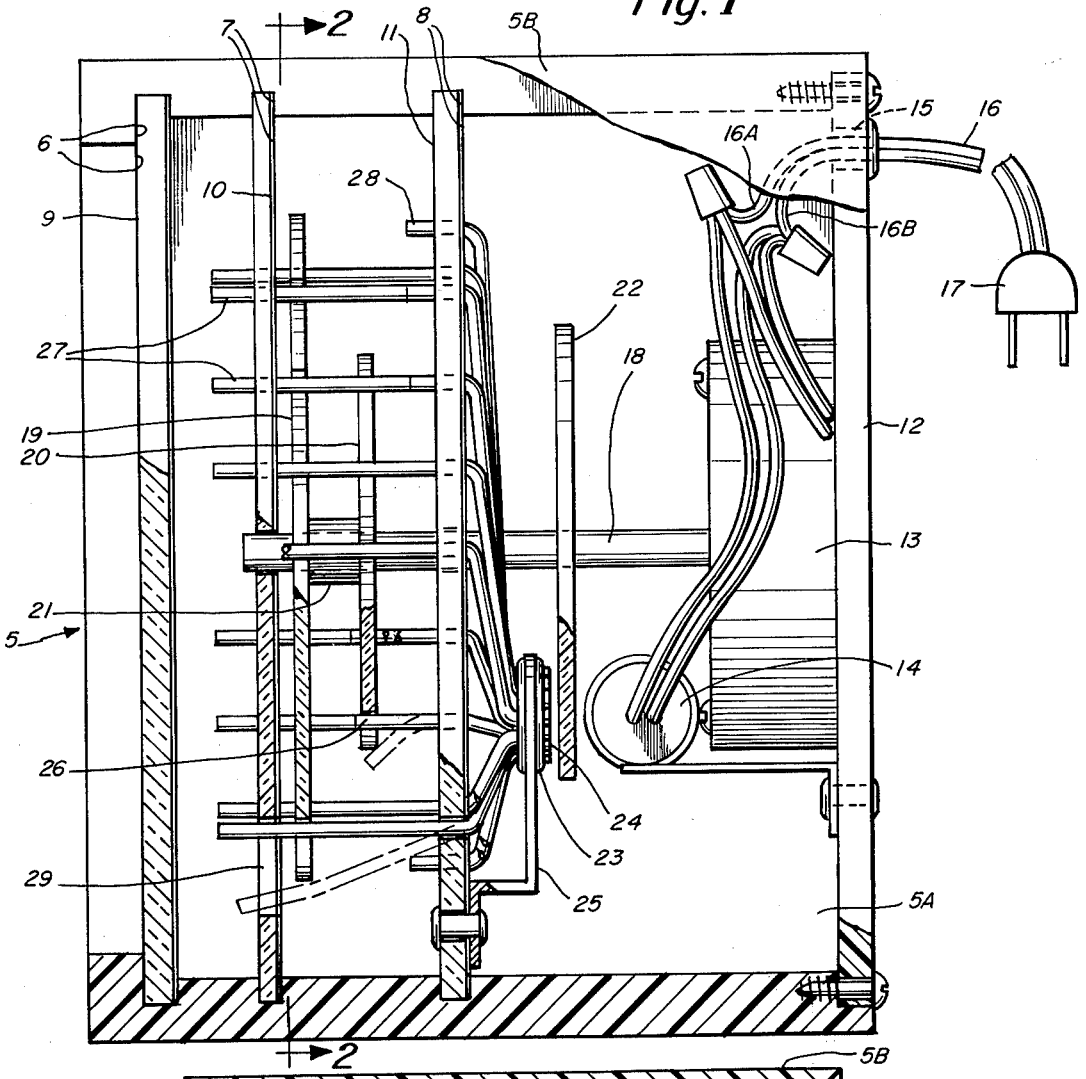
FIG. 1 is a partly sectioned side view of a light display device in accordance with the invention.
Figure 2:
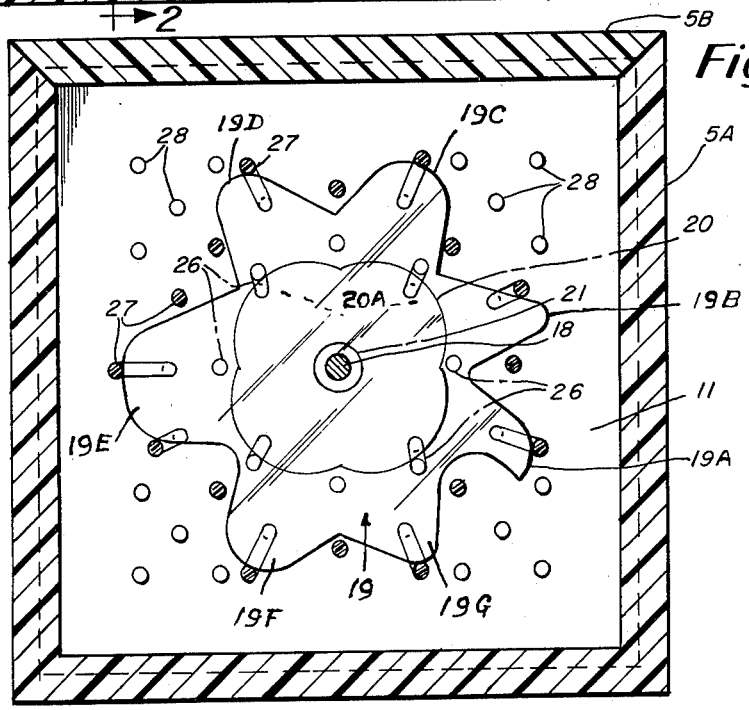
FIG. 2 is a section, on a substantial reduction in scale, taken approximately along the indicated line 2—2 of FIG. 1.
Figure 3:
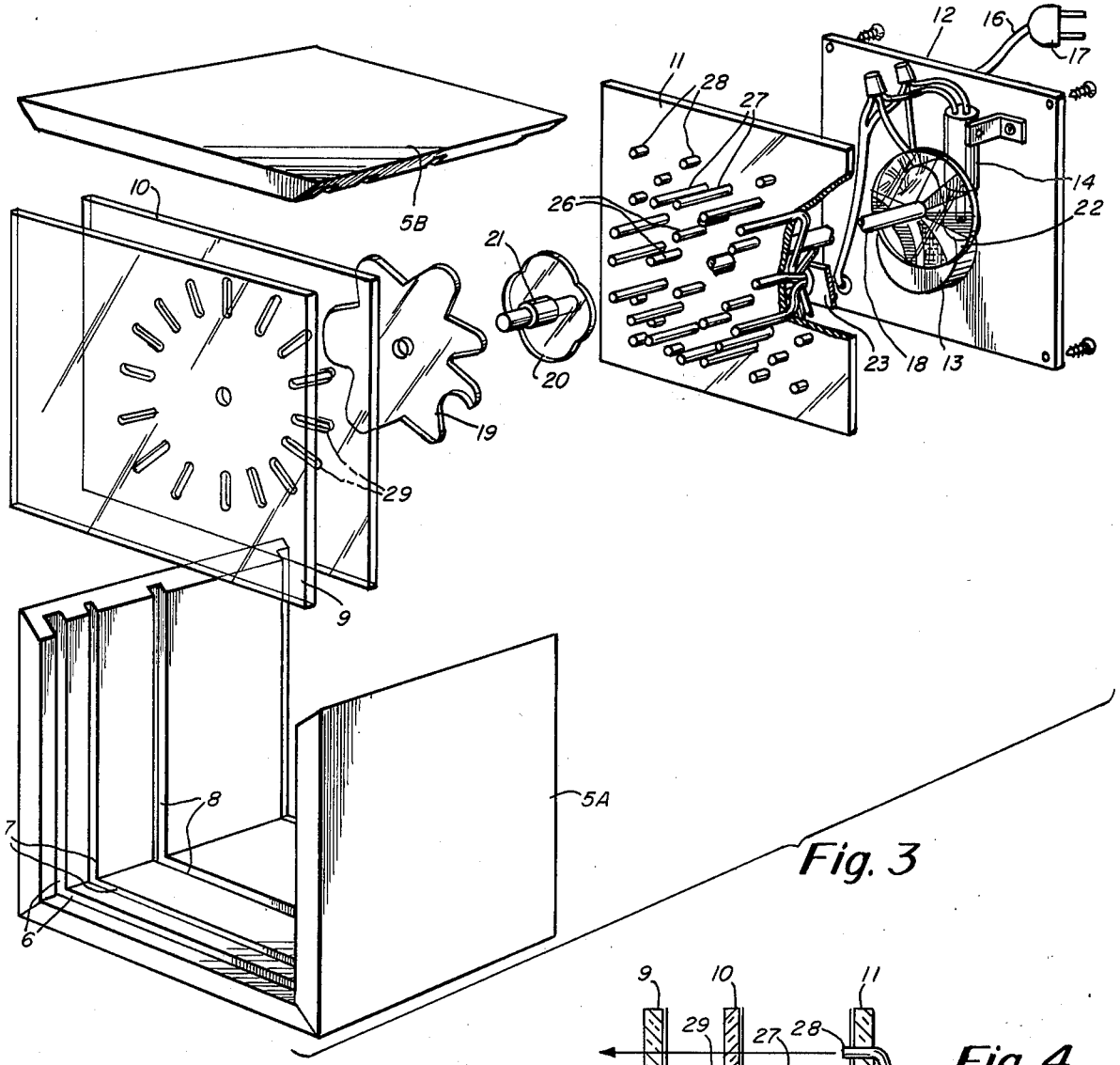
FIG. 3 is an exploded view of the device.

The motor shaft 18 also carries a wheel or disc 22 having sections, see FIG. 3, of different colors. The color wheel is located between the lamp 14 and a holder 23 which is provided with a lens 24 and is held by a bracket 25 shown as attached to the rear of the mirror 11. The holder 23 unites as a bundle corresponding ends of a substantial number of optical fibers including a first inner circular series of fibers 26 concentric with the shaft 18, a second, outer concentric series of fibers 27 and a third series of fibers 28. The fibers of each series extend through the mirror 11 and are held thereby parallel to the shaft 18 and the fibers of each series are of a diameter appropriate for their length to provide free ends in the front section of the box 5 that are resilient and have normal positions at right angles to the window 9.

The optical fibers 26 are disposed with their free ends in the path of the lobes 20A of the cam 20 and terminating short of the one way window 10 while the free ends of the fibers 27 are outside the path of the lobes of the cam 20 and extend forwardly in the path of the lobes of the cam 19 through radial slots 29 in the window 10 and terminate short of the front window 9. The inner end of each slot 29 accommodate the associated fiber 27 when unflexed while its outer slot end limits the extent to which the fibers 27 can be displaced.

In operation, with the color disc 22 and the cams 19 and 20 rotating together, the free ends of the fibers 26 are displaced by the lobes of the cam 20 along substantially regular paths determined by the cam lobes 20A while the free ends of the fibers 27 confined within the slots 29 of the window 10 are displaced radially for a distance and interval determined by the size and shape of the lobes of the cam 19 each of which is shown as differing from the others.

While the free ends of the fibers 27 are confined in the slots 29 so that the extent of their travel under the influence of the lobes of the cam 19 is limited, the lobes are so formed as to affect their movement in both directions in their slots in various ways as determined by the leading and trailing edges of each lobe and the junction between the trailing edge of each cam lobe and the leading edge of the next adjacent cam lobe.

While, in the disclosed embodiment and, as is preferred, each lobe of the cam 19 differs from the others, all the differences between the seven cam lobes wll not be detailed. By way of example, however, the cam lobes 19A and 19E may be compared to illustrate how different rates of filament travel are effected by their respective leading and trailing surfaces. In the case of the cam lobe 19E, the leading and trailing edges are substantially identical. In the case of the cam lobe 19A, its leading edge is similar to but shorter than the leading edge of the cam lobe 19E and its trailing edge is such that the optical fiber 27 engaged by that lobe is free to return by its inherent resiliency to the inner end of the slot 29 by which it is confined. Thus the leading and trailing edgs of each cam lobe control the rate of travel of the filaments 27 which they successively engage and the rate of travel controlled by each edge may be varied. Note that both the leading and trailing edges of the cam lobe 19B provide a substantially uniform rate of travel of a fiber end 27 that is faster than that effected by the corresponding surfaces of the cam lobe 19E.

It should also be noted that while the trailing edge of the lobe 19G and the leading edge of the lobe 19H so merge that the fiber end 27 between them travels substantially continuously, the junction of said edges being spaced radially with respect to the shaft axis to have a circular path just inside the normal positions of the fibers 27. In the disclosed embodiment of the invention, the other merging leading and trailing edges of adjacent lobes define dwells enabling the fiber end or ends 27 between them to be at rest for intervals that vary.

The consequences of the action of the cams 19 and 20 are schematically illustrated in FIG. 4. When any of the fiber ends is disposed normal to the mirrors, light is transmitted directly through the one way sheet or sheets in front of it. When, however, the free ends of the fibers 26 are deflected by the lobes 20A, light is also reflected by the rear surfaces of the windows 9 and 10 with the reflected light also again reflected by the mirror 11. In the case of the fiber ends 27, light therefrom is transmitted directly through the window 9 until those fiber ends are reflected radially by the lobes of the cam 19, light then being both reflected and transmitted by the window 10 and the reflected light again reflected by the mirrors 11. In FIG. 4, the reflected light ray patterns are greatly simplified as it will be appreciated that the extent of the reflection is substantially infinite so that only primary paths of the reflected rays is indicated.

In the disclosed embodiment, there are eight optical fibers 26, sixteen optical fibers 27, and sixteen optical fibers 28 but due to the use of reflective surfaces, the effect is that of myriad moving pin points of light.

It will be appreciated that, when the box is viewed from in front, only the lit ends of the fibers are visible as in practice and as is preferred, the opacity of at least the front window 9 is such as to make the fibers invisible so that a shadow box effect is created. The positions of the lit fiber ends 28 are constant and the lit fiber ends 26 constantly move in a substantially regular manner while the lit fiber ends 27 travel erratically with all lit ends appearing as pin points of light in space of constantly changing color.

We claim:

1. A device for displaying the lit ends of optical fibers, said device including a box provided with a transverse partition dividing the box into front and rear sections, the front of the box a window of one way sheet material, optical fibers extending through said partition with their ends in the front section free, resilient, parallel and at right angles to said window and their ends in the rear section in the form of a bundle, means in said rear section operable to direct light against the bundled ends of the fibers, and means in the front section of the box operable to effect the displacement of and the return of the free ends of at least some of the fibers thereby to produce the effect, when the lit free ends of the fibers are viewed through the window, of pin points of light moving in space.

2. The device of claim 1 in which the opacity of the window is such that only the free ends of the fibers, when lit, are visible through the window.

3. The device of claim 1 in which the partition is a mirror parallel to and facing the window.

4. The device of claim 1 in which the means in the rear section is operable to direct light of constantly changing color against the bundled ends of the fibers.

5. The device of claim 1 in which some of the free fiber ends are stationary.

6. The device of claim 1 in which the displacing means includes a shaft extending through the partition, a motor in the rear section is coupled to the rear end of the said shaft, a cam is fixed on said shaft in the front section, and the free ends of the fibers that are to be displaced are arranged as a circular set concentric with the shaft in position to be displaced and released as the cam rotates.

7. The device of claim 6 in which the means operable to direct light against the bundled ends of the fibers includes a lens, a light source mounted in the rear section and a color wheel fast on the shaft and between the light source and the lens.

8. The device of claim 6 in which the cam includes a plurality of identical lobes of a size and shape to effect uniform displacements of the ends of the fibers.

9. The device of claim 6 in which the cam includes a plurality of dissimilar lobes of sizes and shapes to effect irregular displacement of the ends of the fibers.

10. The device of claim 6 and a second cam in the front section and fixed on said shaft rearwardly of the first cam, the maximum radial extent of the second cam less than that of the first cam and the free ends of the fibers that are to be displaced include a second circular set concentric with said first set and positioned to be displaced and released by said second cam, said first cam translucent.

11. The device of claim 10 and a second window of one way sheet material between said first named window and said partition, said second window having a series of apertures concentric with said shaft through which extend the fiber ends that are to be displaced by the first named cam, said apertures shaped and dimensioned to permit wanted movement of said fiber ends.

12. The device of claim 11 in which the apertures are radial slots.

13. The device of claim 12 in which the first cam includes lobes each shaped and dimensioned to effect differing rates of travel of the fiber ends as they travel lengthwise of the slots and the second cam includes lobes shaped and dimensioned to effect uniform travel of the fiber ends of the second set as they are displaced and released.

* * * * *